US010539306B1

(12) United States Patent
Hwang

(10) Patent No.: US 10,539,306 B1
(45) Date of Patent: Jan. 21, 2020

(54) DOUBLE LAMPSHADE TABLE LAMP

(71) Applicant: METROMAX AMERICA CORPORATION, Rowland Heights, CA (US)

(72) Inventor: Christina Hwang, Rowland Heights, CA (US)

(73) Assignee: METROMAX AMERICA CORPORATION, Rowland Heights, CA (US)

( * ) Notice: Subject to any disclaimer, the term of this patent is extended or adjusted under 35 U.S.C. 154(b) by 0 days.

(21) Appl. No.: 16/377,476

(22) Filed: Apr. 8, 2019

(51) Int. Cl.
*F21V 21/26* (2006.01)
*F21S 6/00* (2006.01)

(52) U.S. Cl.
CPC ..... *F21V 21/26* (2013.01); *F21S 6/003* (2013.01)

(58) Field of Classification Search
CPC ..... F21V 21/26; F21S 6/003
See application file for complete search history.

(56) References Cited

U.S. PATENT DOCUMENTS 8,256,925 B2 * 9/2012 Yuan ..... F21V 21/06 362/249.07

* cited by examiner

*Primary Examiner* — Thomas M Sember

(57) ABSTRACT

A double lampshade table lamp includes a base, a flexible pole vertically erected from the top of the base, and two lampshade assembly horizontally pivoted to the top of the pole and each having a light tube. The flexible pole can be bent to change the angle of the two lampshade assemblies, and the rear ends of the two lampshade assemblies respectively have bushings which are in a vertical staggered relation to each other and pivoted to the top of the pole, so that the two lampshade assemblies are situated at the same height and can be deflected to provide concentrated and focused light and a fan-shaped expansion of the lighting area.

7 Claims, 11 Drawing Sheets

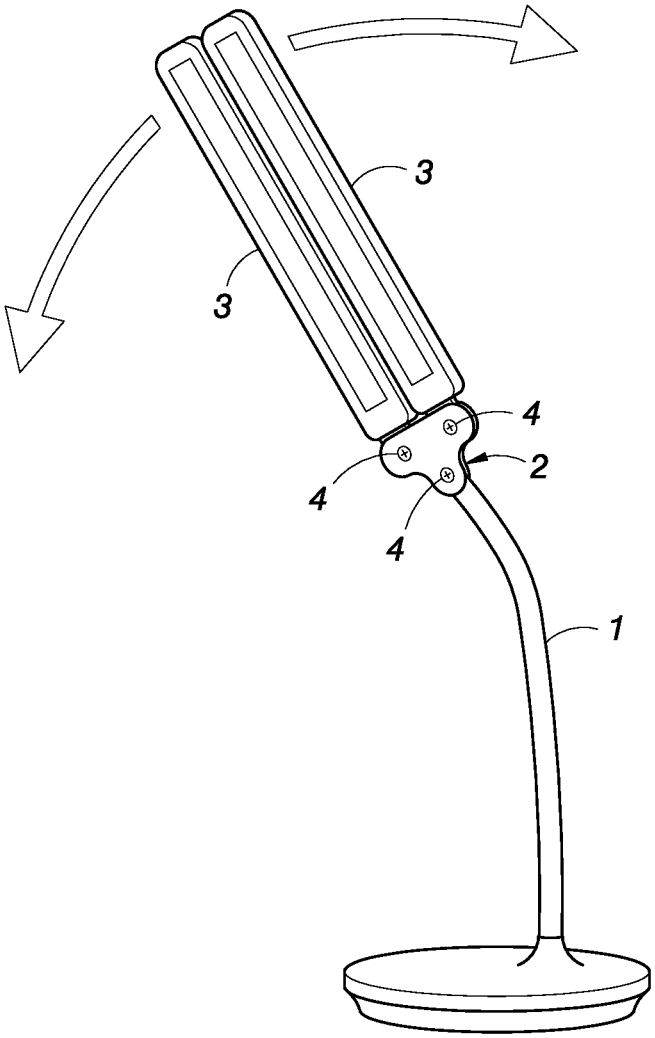
PRIORART
FIG.1

DOUBLE LAMPSHADE TABLE LAMP

FIELD OF THE INVENTION

The present invention relates to a table lamp having two lampshades, and the two lampshades have the effects of providing concentrated and focused light and deflecting the light for a fan-shaped expansion of the lighting area.

BACKGROUND OF THE INVENTION

In general, a traditional table lamp includes a base disposable on a table, a pole vertically erected from the top of the base, and a lampshade assembly pivoted to the top of the pole and having a light tube, and the light tube produces a light effect and provides appropriate lighting to users.

The basic structure of the aforementioned traditional table lamp has been used for years, and its use can provide lighting for a single user only. If two users sit side-by-side on the same side or face-to-face on opposite sides of a table, then two table lamps will be required. In addition, many single-user L-shaped desks also require two table lamps to provide sufficient lighting on both sides of the desk.

Therefore, a commercial table lamp with double lampshades as shown in FIG. 1 is introduced. Unlike the traditional table lamp just having one lampshade assembly and providing a lighting effect for fixed areas only, the double lampshade table lamp has two lampshade assemblies 3 coupled to the top of a pole 1 by a pivot joint 2, and the two lampshade assemblies 3 can be deflected with respect to the pivot joint 2 to allow users to adjust the lighting range of the two lampshade assemblies 3.

In the aforementioned structure of the traditional double lampshade table lamp, the pivot joint 2 has three pivot shafts 4 arranged into a substantially triangular shape and provided for pivotally connecting the two lampshade assemblies 3 and one pole 1, wherein the axes of the three pivot shafts 4 are configured axially with the axis of the pole 1. In the condition of the pole 1 having no bending angle, the two lampshade assemblies 3 project light to the front. In a general using condition, the lampshade assembly 3 projects light onto the desk, and the users need to bend the pole 1 in order to adjust the lighting angle of the lampshade assembly 3 or adjust the two lampshade assemblies 3 to an appropriate lighting position. Obviously, the traditional double lampshade table lamp is inconvenient to use.

Furthermore, the pivot joint 2 has three pivot shafts 4, and alignments and screw connections are required for several times in the assembling process, and thus the manufacturing time and cost cannot be reduced effectively. Therefore, finding a way to improve the complicated structure and the inconvenient use of the traditional double lampshade table lamp is a main subject of the present invention.

SUMMARY OF THE INVENTION

Specifically, the present invention discloses a double lampshade table lamp comprising a base, a flexible pole vertically erected from the top of the base, and two lampshade assemblies horizontally pivoted to the top of the pole and capable of bending the flexible pole to change the angle of the two lampshade assemblies, characterized in that a shaft seat is coaxially installed to the top of the pole, and each of the two lampshade assemblies comprises an electrical connector for positioning a light tube, and the lampshade covers the top of the light tube and the electrical connector, and the rear end of each of the two lampshades has a bushing pivotally coupled to the outer periphery of the shaft seat, and the two bushings are in a vertical staggered relation to each other, such that the two lampshades are situated at the same height, and the two lampshades can be deflected by using the shaft seat as the axis to achieve the effect of providing concentrated and focused light or deflecting the light to the left and right sides for a fan-shaped expansion of the lighting area.

Compared with the prior art, the two lampshade assemblies of the present invention have the bushings vertically staggered with each other and pivotally coupled to the same shaft seat, so that the assembling and manufacturing time can be reduced, and after the two lampshade assemblies are assembled with the shaft seat, the two lampshade assemblies are situated at the same height and project light to the table, and the lampshade assemblies can be deflected by using the shaft seat as the axis to achieve the effect of providing concentrated and focused light or deflecting the light to the left and right sides for a fan-shaped expansion of the lighting area, so as to improve the convenience of use.

The technical contents of the present invention will become apparent with the detailed description of preferred embodiments accompanied with the illustration of related drawings as follows. It is intended that the embodiments and figures disclosed herein are to be considered illustrative rather than restrictive.

BRIEF DESCRIPTION OF THE DRAWINGS

FIG. 1 is a perspective view of a conventional double lampshade table lamp;

DESCRIPTION OF THE PREFERRED EMBODIMENTS

Figure 2:
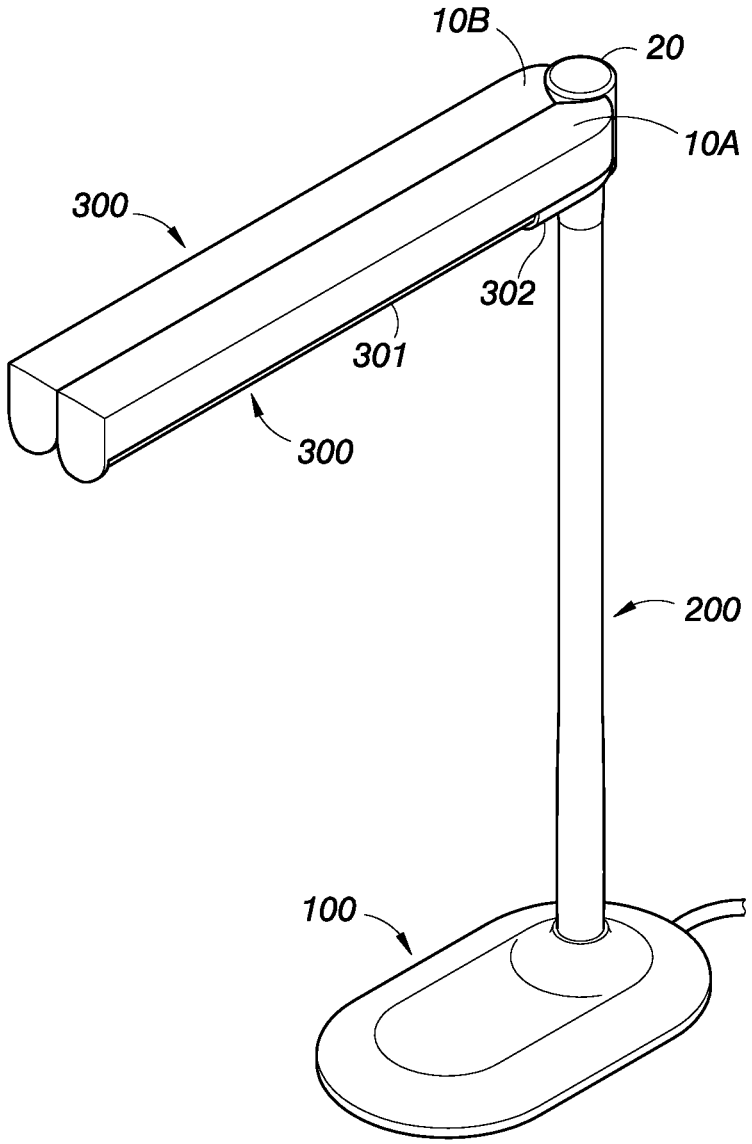
FIG. 2 is a perspective view of a double lampshade table lamp of the present invention.
Figure 3:
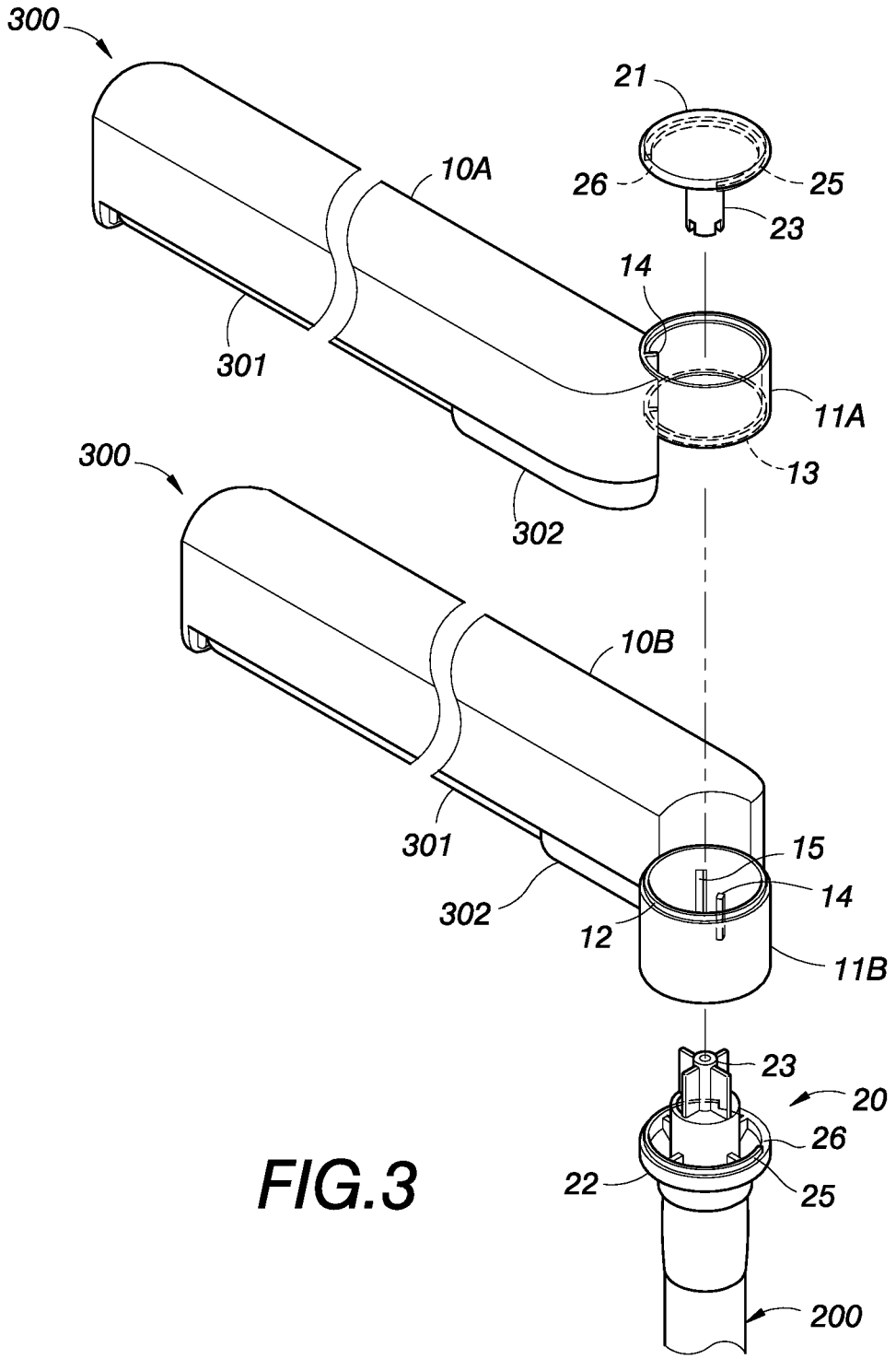
FIG. 3 is a partial exploded view of a double lampshade table lamp of the present invention.

With reference to FIGS. 2 and 3 for a double lampshade table lamp of the present invention, the double lampshade table lamp comprises a base 100, a flexible pole 200 vertically erected from the top of the base 100, and two lampshade assemblies 300 pivotally coupled to the top of the pole 200, wherein the two lampshade assemblies 300 are horizontally pivoted to the top of the pole 200, and when the table lamp is set on a table and the pole 200 is not bent, the two lampshade assemblies 300 project light on the table directly, and the use is very convenient.

Each of the two lampshade assemblies 300 comprises an electrical connector 302 for positioning the light tube 301, and a lampshade 10A, 10B for covering the top of the light tube 301 and the electrical connector 302. In an embodiment, the light tube 301 is an LED light tube.

Figure 4:
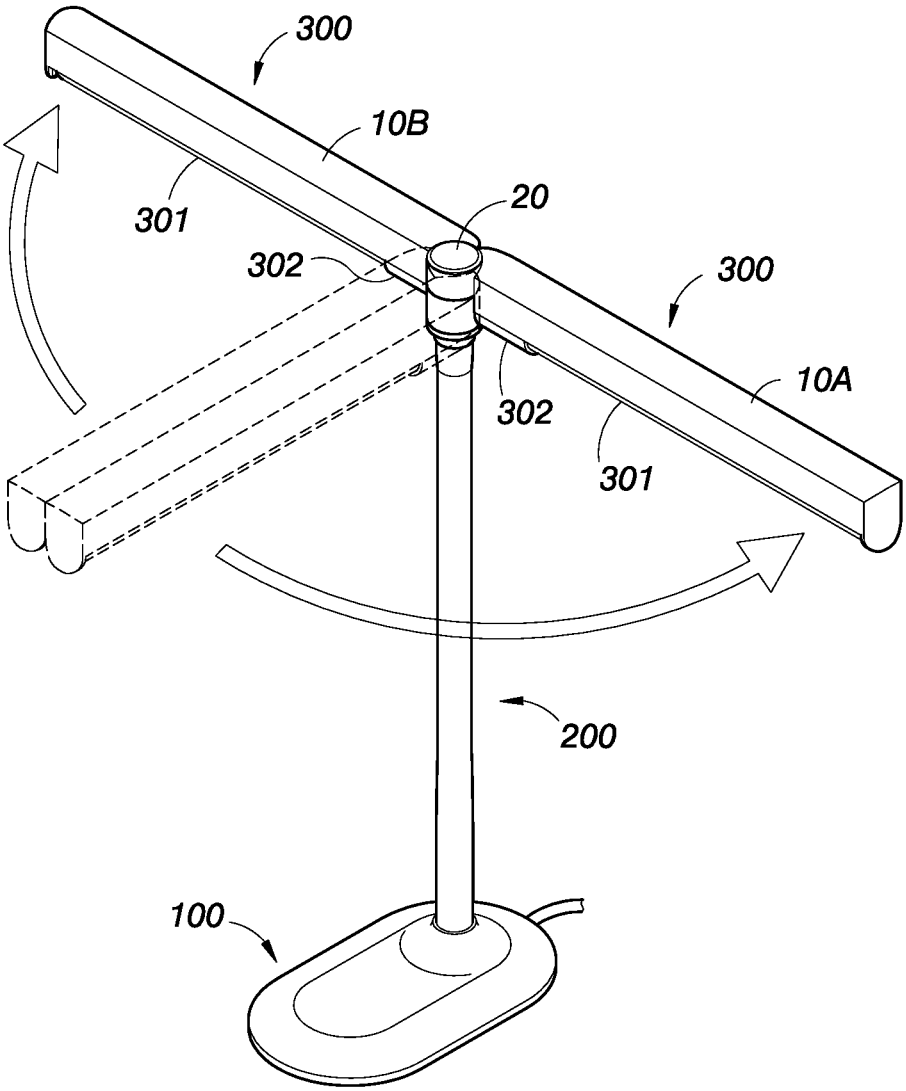
FIG. 4 is a schematic view showing the deflection of two lampshade assemblies of the present invention.

A shaft seat 20 is coaxially installed to the top of the pole 200, and the rear end of each of the two lampshades 10A, 10B has a bushing 11A, 11B pivotally coupled to the outer periphery of the shaft seat 20, and the two bushings 11A, 11B are in a vertical staggered relation to each other as shown in the figure, and the bushing 11A is disposed at the top of the lampshade 10A, and the bushing 11B is disposed at the bottom of the lampshade 10B, so that the two lampshades 10A, 10B are situated at the same height, and the two lampshades 10A, 10B can be deflected by using the shaft seat 20 as the axis. For example, the two lampshades 10A, 10B are close to each other to define a concentrated and focused lighting status as shown in FIG. 2 or they are deflected to the left and right sides respectively to define a fan-shaped shape expansion status to expand the lighting area as shown in FIG. 4.

Figure 8:
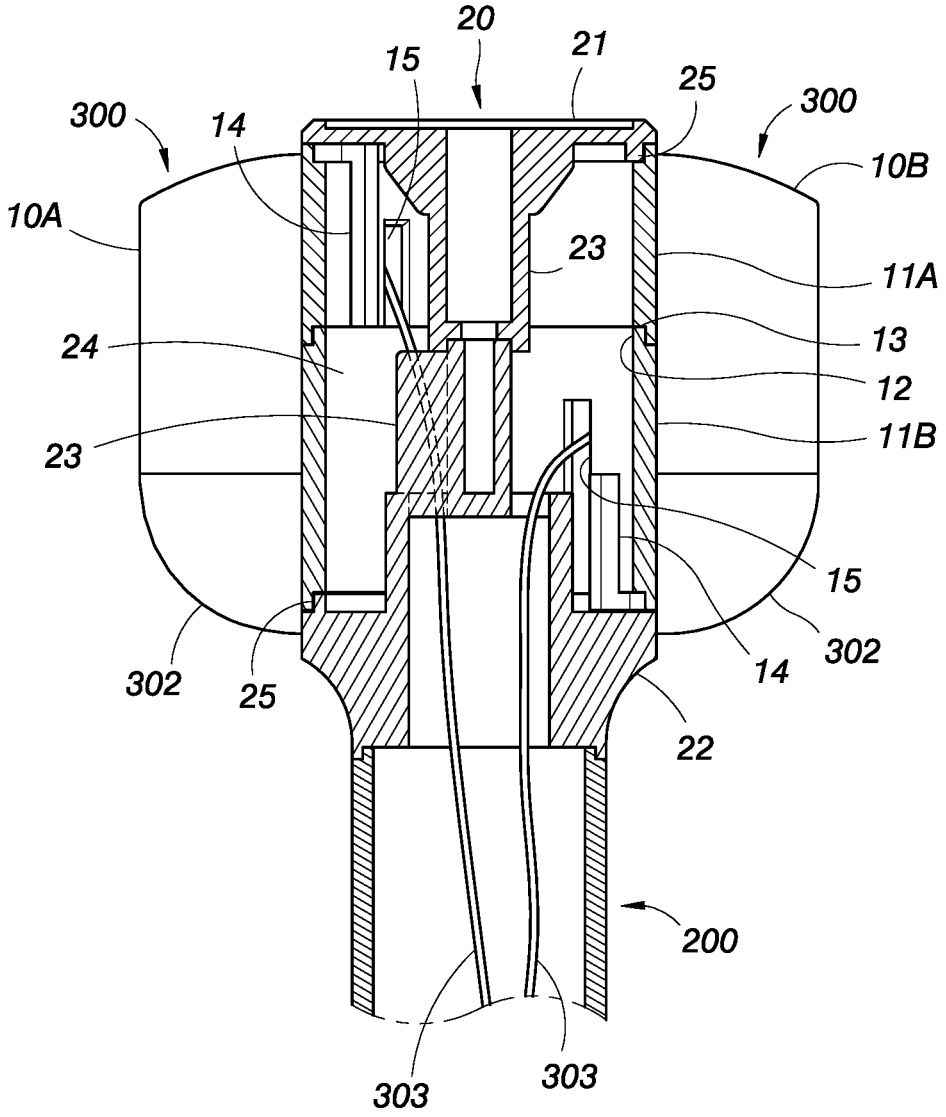
FIG. 8 is a schematic view showing a combined structure of a shaft seat and two bushings in accordance with the present invention.

In FIG. 3, the shaft seat 20 comprises a limit disk 21 disposed at the top of the upper bushing 11A and covering the upper bushing 11A, a limit seat 22 disposed at the bottom of the lower bushing 11B for the purpose of carrying, and the limit seat 22 is fixed to the top of the pole 200, and each of the central positions of the limit disk 21 and the limit seat 22 has a shaft 23, and the two shafts 23 are vertically and coaxially coupled to each other and disposed at the inner peripheries of the two bushings 11A, 11B respectively, so that an accommodation space 24 is formed between the inner peripheries of the two bushings 11A, 11B and the two shafts 23 (refer to FIG. 8 as well).

In addition, the top of the lower bushing 11B and the bottom of the upper bushing 11A respectively have a convex ring 12 and a concave ring 13 that can be engaged with each other and vertically positioned, so that after the two bushings 11A, 11B are vertically engaged with each other, the two lampshades 10A, 10B can be deflected to the left and right sides with respect to the shaft seat 20.

To prevent the two lampshades 10A, 10B from deflecting too much, the limit disk 21 and the limit seat 22 have positioning rings 25 disposed on the respective inner sides and embedded into the inner peripheries of the two bushings 11A, 11B respectively, and the two positioning rings 25 have an arc notch 26 each, and a limit column 14 is protruded separately from the inner periphery of each of the two bushings 11A, 11B and extended into the respective arc notch 26.

Figure 5:
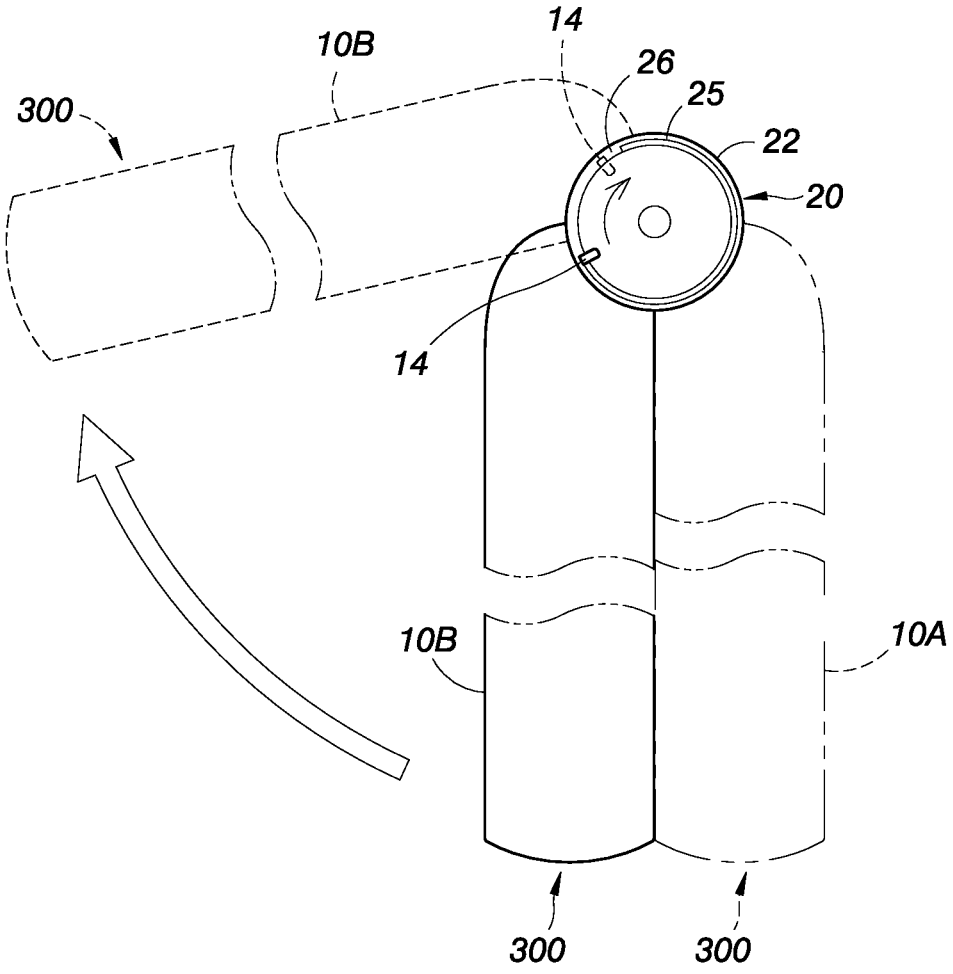
FIG. 5 is a schematic view showing the deflection of one of the two lampshades of the present invention.
Figure 6:
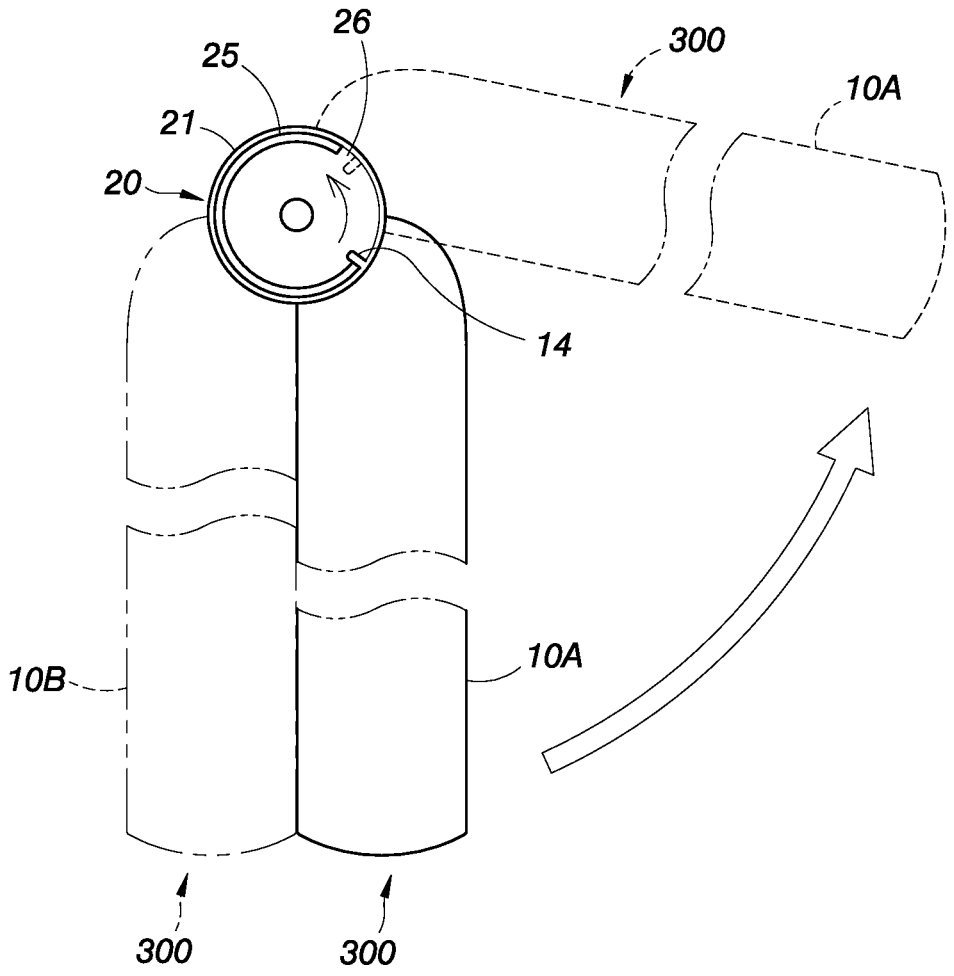
FIG. 6 is a schematic view showing the deflection of the other lampshade of the present invention.
Figure 7:
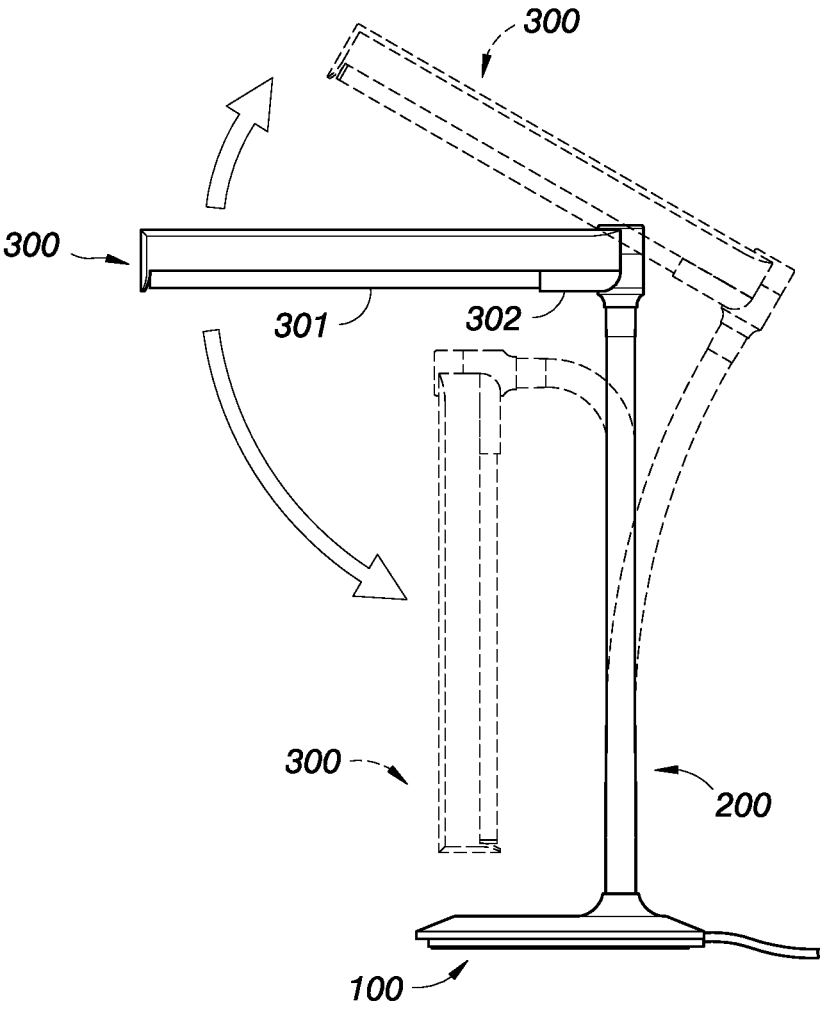
FIG. 7 is a schematic view of bending a flexible pole of the present invention.

When the two lampshades 10A, 10B are deflected by using the shaft seat 20 as the axis, the limit column 14 of the lampshade 10B as shown in FIG. 5 can be moved in the arc notch 26 of the limit seat 22, and the limit column 14 of the lampshade 10A as shown in FIG. 6 can be moved in the arc notch 26 of the limit disk 21, the moving stroke of the respective limit column 14 is limited by the arc notch 26, so as to restrict the deflection angle of the two lampshades 10A, 10B, so that the two lampshades 10A, 10B have a deflection stroke from 0 degree to +95 degrees or −95 degrees with respect to the shaft seat 20. In FIG. 7, the flexible pole 200 is bent to change the angle of the two lampshade assemblies 300 and allow users to adjust the lighting direction, the lighting height and the lighting range of the two lampshades 10A, 10B.

In FIGS. 2 and 4, when the two lampshades 10A, 10B are close to each other to provide concentrated and focused lighting, the relative position of the two lampshades 10A, 10B and the shaft seat 20 is 0 degree, and the included angle between the two lampshades 10A, 10B is 0 degree. When the two lampshades 10A, 10B are deflected to the left and right sides respectively to the largest possible angle for a fan-shaped expansion of lighting, the relative positions of the two lampshades 10A, 10B and the shaft seat 20 are approximately equal to +95 degrees and −95 degrees, and the included angle between the two lampshades 10A, 10B is approximately equal to 190 degrees, so that when two users are sitting side-by-side on the same side or face-to-face on opposite sides of a table, the two lampshades can be deflected to an appropriate angle to let the two users have sufficient lighting.

In FIG. 8, a through opening 15 is formed on a side of the two bushings 11A, 11B and the limit seat 22 of the shaft seat 20 respectively and provided for passing and installing two electric wires 303, and the two electric wires 303 are passed from the through openings 15 of the two bushings 11A, 11B into the accommodation space 24 of the shaft seat 20 and then passed through the through opening 15 of the limit seat 22 and hidden into the pole 200.

Figure 9:
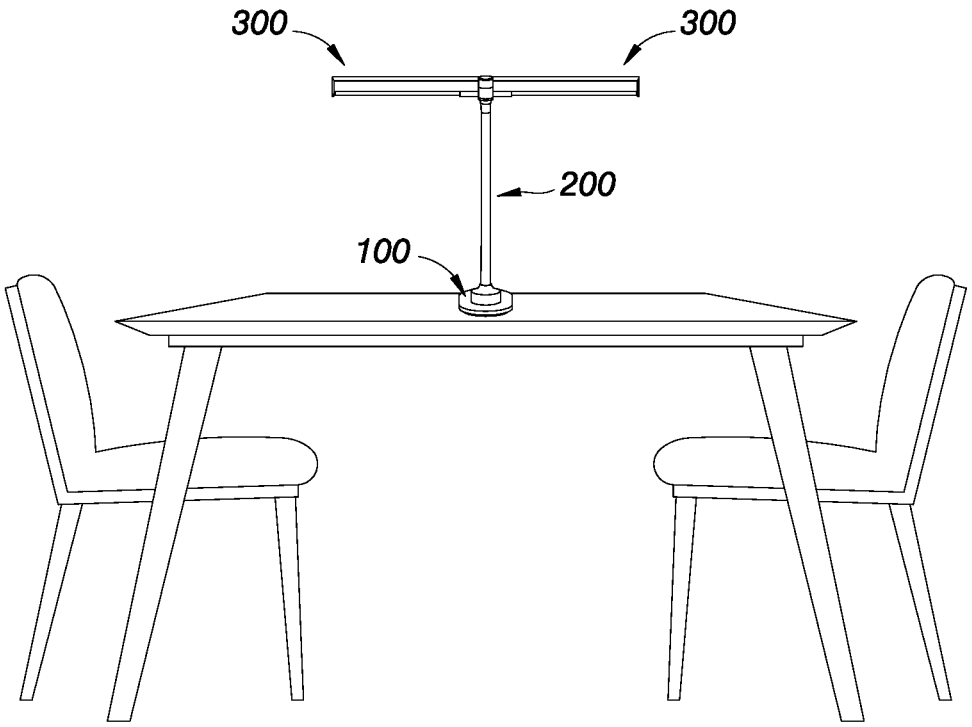
FIG. 9 is a schematic view showing that two users are sitting opposite to each other in the same table and using a double lampshade table lamp of the present invention.
Figure 10:
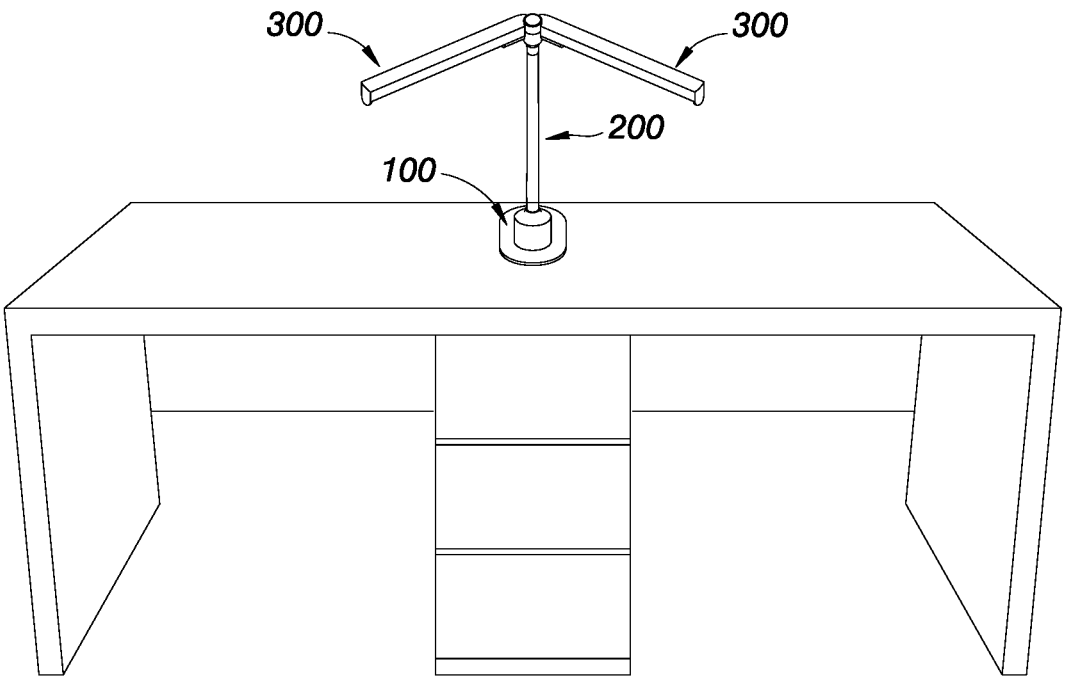
FIG. 10 is a schematic view showing that two users are sitting side by side in the same table and using a double lampshade table lamp of the present invention.
Figure 11:
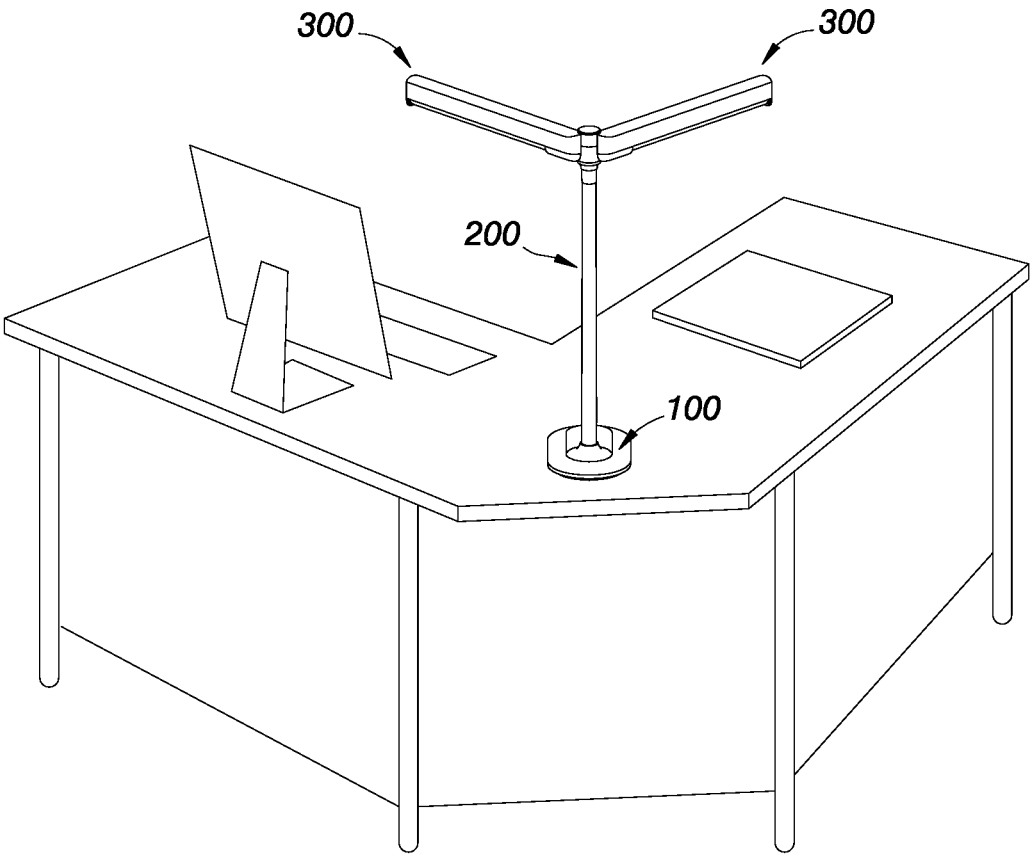
FIG. 11 is a schematic view of using a double lampshade table lamp disposed on an L-shaped desk in accordance with the present invention.

In addition, the table lamp further comprises two switches (not shown in the figure) respectively and electrically coupled to the two electrical connectors 302, and the two switches are capable of controlling and determining whether or not to electrically conduct the two electrical connectors 302, so as to control the ON/OFF of the two light tubes, and allow users to selectively turn on the two light tubes at the same time. Therefore, when the double lampshade table lamp is set on a table with two users sitting face-to-face on two opposite sides of the table as shown in FIG. 9, or set on a table with two users sitting side-by-side on the same side of the table as shown in FIG. 10, or set on an L-shaped desk as shown in FIG. 11, the users can adjust the lighting area of the two lampshades as needed, and also can control the ON/OFF of the two light tubes to improve the convenience of use.

What is claimed is:

1. A double lampshade table lamp, comprising a base, a flexible pole vertically erected from a top of the base, and two lampshade assemblies horizontally pivoted to a top of the pole, the flexible pole capable of bending to change an angle of the two lampshade assemblies, characterized in that a shaft seat is coaxially installed on the top of the pole, and each of the two lampshade assemblies comprises an electrical connector for engaging a respective light tube, and a lampshade covers a top of each light tube and respective electrical connector, and a rear end of each of the two lampshades has a bushing pivotally coupled to an outer periphery of the shaft seat, the two bushings in a stacked relation to each other and configured so that the two lampshades are situated at a same height, and the two lampshades are deflectable by using the shaft seat as an axis to achieve an effect of providing concentrated and focused light or deflecting light to left and right sides for a fan-shaped expansion of a lighting area.

2. The double lampshade table lamp according to claim 1, wherein the two lampshades are deflectable from 0 degrees to +95 degrees or −95 degrees with respect to the shaft seat, and when the two lampshades are set side by side to provide concentrated lighting, relative positions of each lampshade and the shaft seat is 0 degrees, and an included angle between the two lampshades is 0 degrees; and when the two lampshades are deflected towards the left and right sides to a largest possible angle for the fan-shaped expansion of lighting, the relative positions of the two lampshades and the shaft seat are approximately equal to +95 degrees and −95 degrees, and the included angle between the two lampshades is approximately equal to 190 degrees.

3. The double lampshade table lamp according to claim 2, wherein the shaft seat comprises a limit disk disposed at a top of the shaft seat for covering a top of the bushing, a limit seat disposed at a bottom of the shaft seat for carrying the limit seat, and the limit seat is fixed to the top of the pole, and central positions of the limit disk and the limit seat have shafts vertically and coaxially coupled to each other, and the two shafts are situated at an inner periphery of the two bushings.

4. The double lampshade table lamp according to claim 3, wherein the limit disk and the limit seat have two positioning rings disposed at corresponding inner sides and embedded into the inner periphery of the bushings respectively, and each of the two positioning rings has an arc notch, and the inner periphery of the two bushings has a limit column extending to a respective arc notch, and when the two lampshades are deflected by using the shaft seat as the axis, the two limit columns are moved into the respective arc notches synchronously, and the arc notch is provided for limiting a moving stroke of the limit column to restrict a deflection angle of the two lampshades.

5. The double lampshade table lamp according to claim 4, wherein a top of the lower bushing and a bottom of the top bushing respectively have a convex ring and a concave ring engaged with each other and vertically positioned, so that the two lampshades are deflectable to the left and right sides.

6. The double lampshade table lamp according to claim 4, wherein each of the two bushings has a through opening formed on a side of the bushing and disposed on the limit seat of the shaft seat for passing two electric wires, and the two electric wires are passed from the through openings of the two bushings into the shaft seat respectively and then through a through opening of the limit seat and hidden into the pole.

7. The double lampshade table lamp according to claim 1, further comprising two switches respectively and electrically coupled to the two electrical connectors, for controlling and determining whether to turn on or off the two light tubes.

* * * * *